United States Patent [19]

Tada et al.

[11] 4,338,606

[45] Jul. 6, 1982

[54] ANTENNA SYSTEM WITH VARIABLE DIRECTIVITY

[75] Inventors: Masahiro Tada, Yokohama; Yoshio Ishigaki, Tokyo; Koji Ouchi; Kōya Nakamichi, both of Yokohama, all of Japan

[73] Assignee: Sony Corporation, Tokyo, Japan

[21] Appl. No.: 104,909

[22] Filed: Dec. 18, 1979

[30] Foreign Application Priority Data

Dec. 21, 1978 [JP] Japan ..... 53-158218
Dec. 21, 1978 [JP] Japan ..... 53-158219

[51] Int. Cl.[3] ..... H01Q 3/24

[52] U.S. Cl. ..... 343/744; 343/876; 455/277

[58] Field of Search ..... 343/743, 744, 788, 742, 343/876; 455/277

[56] References Cited

U.S. PATENT DOCUMENTS 3,202,995 8/1965 Schultz ..... 343/732
3,671,970 6/1972 Layton ..... 343/744
3,956,751 5/1976 Herman ..... 343/744
4,145,694 3/1979 Sletten ..... 343/876
4,193,077 3/1980 Greenberg et al. ..... 343/876

*Primary Examiner*—Eli Lieberman
*Attorney, Agent, or Firm*—Hill, Van Santen, Steadman, Chiara & Simpson

[57] ABSTRACT

An antenna system is disclosed which has a loop antenna divided into n conductive members at n pairs of divisional points where n is a positive integer not smaller than 2, n feeders connected to the n pairs of divisional points respectively, a signal feeding point, and at least one impedance element. In this case, electrical switching circuits are connected between the n feeders and the impedance element, and an electrical control circuit is connected to the electrical switching circuits for selectively connecting the feeding point to one of the n feeders and at the same time for selectively connecting the impedance element to another of the n feeders, so that the directivity characteristic of the antenna system is variable controlled.

7 Claims, 33 Drawing Figures

ANTENNA SYSTEM WITH VARIABLE DIRECTIVITY

BACKGROUND OF THE INVENTION

1. Field of the Invention

The present invention relates generally to an antenna system for receiving a television broadcast wave, a radio broadcast wave and so on, and is directed more particularly to an antenna system whose direction and directivity characteristic can be varied.

2. Description of the Prior Art

In general, the arriving direction of a broadcast wave at an antenna system differs dependent upon the broadcast station whose signals are being received. There are two cases. One of them is the simplest case where the position of a transmission antenna is different from that of a broadcast station. The other case is one where electric waves from different stations are being broadcast from a single transmission antenna system, and the directions of the broadcast waves arriving at a receiving antenna system become different due to reflection and diffraction of the waves or frequencies thereof. Further, there may be situations where even if the same wave is broadcast, it may be separated by the reflection and diffraction into a plurality of waves and the separated waves arrive at the receiving antenna system from different directions.

In general, a portable antenna system is located in a room so that the above diffraction and reflection of the wave appear remarkably.

Therefore, it is required that the direction and directivity characteristic of the receiving antenna system be varied in accordance with the wave of a station to be received. For example, the portable antenna system is manually moved to vary its directivity characteristic or direction. In this case, since a user contacts or is near the antenna (antenna conductor), its directivity characteristic or arriving manner of waves becomes different. Therefore, there may be a concern that when the user is separated from the antenna system or device, even if the antenna device is positioned optimum to receive the wave, the receiving state becomes deteriorated.

To avoid the above defect, there has been proposed in the art that in order to remotely vary the direction of an antenna device, a motor be provided on the antenna device and that the motor be remotely controlled through a control line to thereby rotate the antenna, and hence to vary the direction of the antenna.

With the above antenna device, however, a noise is generated by the rotation of the motor and this noise affects the reception at the receiver. A mechanical noise generated by the rotation of the motor is also discomfortable to a user.

OBJECTS AND SUMMARY OF THE INVENTION

Accordingly, an object of the present invention is to provide an antenna system in which, without rotating an antenna per se, its direction or directivity characteristic may be varied to avoid the noise in a receiver and also avoid the generation of mechanical noise.

Another object of the invention is to provide a portable antenna system in which the direction or directivity characteristic of an antenna device may be varied remotely or without coming close to the antenna device.

According to one aspect of the present invention, an antenna system is provided which comprises a loop antenna divided into n conductive members at n pairs of divisional points wherein n is a positive integer not smaller than 2;

n feeders connected to said n pairs of divisional points respectively;

a signal feeding point; and at least one impedance element; characterized by electrical switching means connected between said n feeders and said signal feeding point and also connected between said n feeders and said impedance element; and electrical control means connected to said electrical switching means for selectively connecting said feeding point to one of said n feeders and at the same time for selectively connecting said impedance element to another of said n feeders whereby the directivity characteristic of said antenna system is variably controlled.

The other objects, features and advantages of the invention will become apparent from the following description taken in conjunction with the accompanying drawings through which the like references designate the same elements.

DESCRIPTION OF THE PREFERRED EMBODIMENTS

An example of the present invention will be hereinafter described with reference to the attached drawings in which the invention is described with reference, for example, to a portable antenna system for receiving a VHF television broadcast wave.

Figure 1:
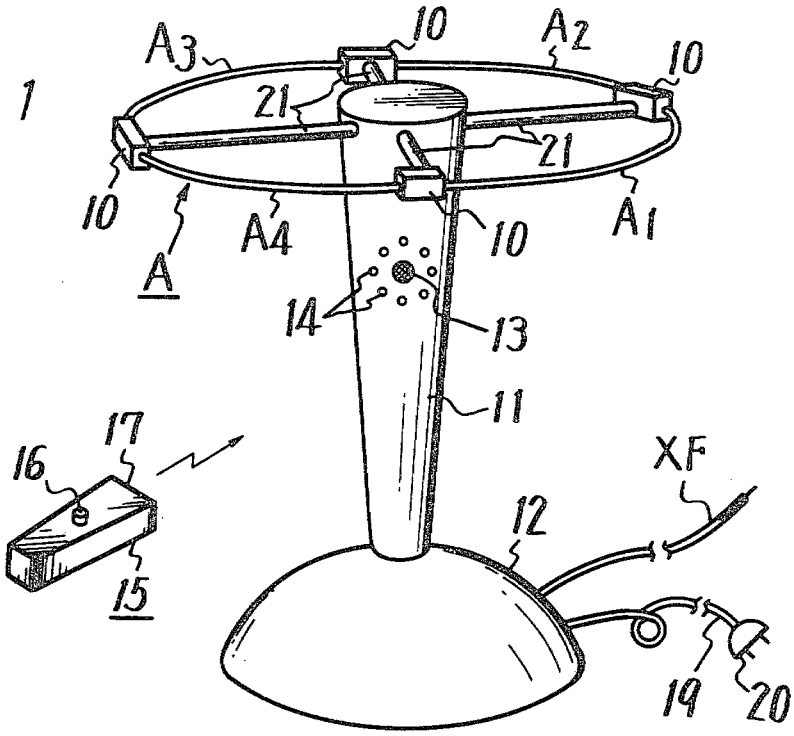
FIG. 1 is a perspective view showing the apparatus of an example of the antenna system according to the present invention.

Turning first to FIG. 1, one preferred example of the antenna system of this invention will be now described. Reference letter A identifies an antenna which is in the form of a loop antenna, by way of example. The antenna A is divided into a plurality, for example, four conductive members A1, A2, A3 and A4. The conductive members A1 to A4 are supported by insulating blocks 10 at the respective opposing divided points thereof. The antenna A is supported by a cylindrical support post 11 to which is held vertical and to which the insulating blocks 10 are connected through support arms 21, whereby the antenna A is kept horizontal with the support post 11 as the center. The support post 11 is vertically supported in a base 12. In FIG. 1, 19 designates a power source cord 20 having a plug connected to its free end and XF is a coaxial cable of 75Ω serving as a feeding cable.

With the above antenna system of this invention, the direction or directivity characteristic of the antenna A is remotely controlled and a receiving element 13 is provided in the support post 11. A control transmitter 15 is provided which will transmit an electric wave, ultrasonic wave, infrared ray or the like toward the receiver 13 from its transmitting element 17 to vary the direction or directivity characteristic of the antenna A. The transmitter 15 is provided with an operation element 16. An indicator 14 such as one formed of luminous diodes is provided on the post 11 which will indicate the condition of the direction of directivity characteristic of the antenna A.

Figure 2:
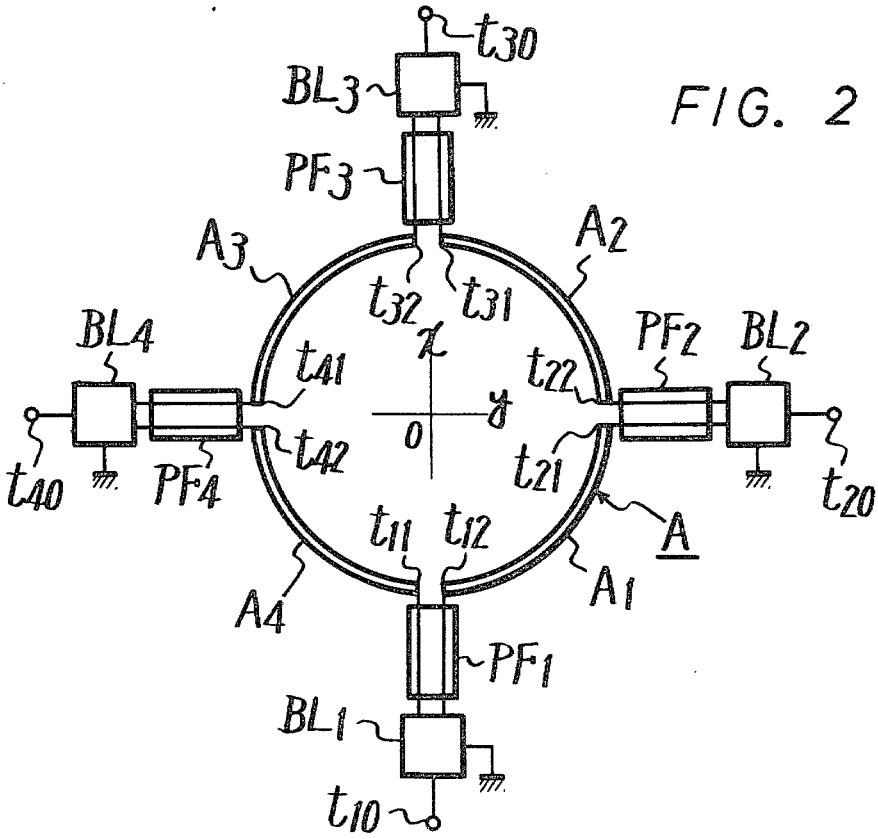
FIG. 2 is a plan view showing essential parts of the antenna system of the embodiment of the invention shown in FIG. 1.
Figure 3:
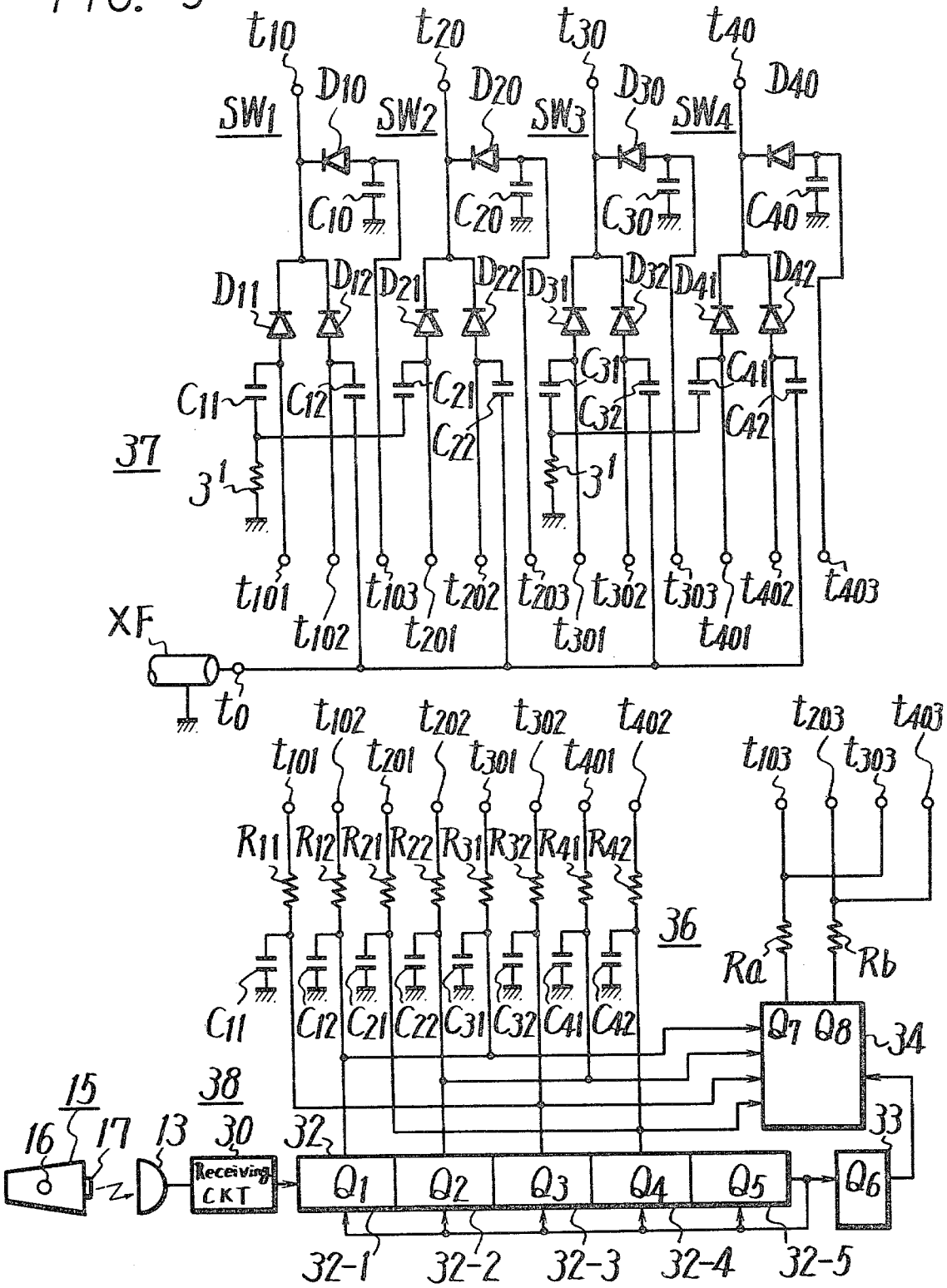
FIG. 3 is a circuit diagram showing a control means for the antenna system of the invention.
Figure 4A:
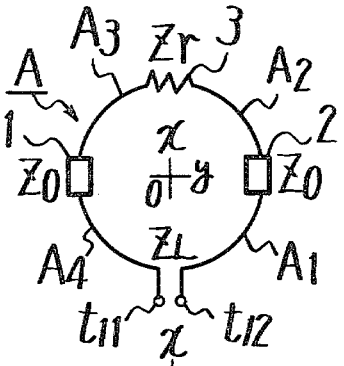
FIGS. 4 to 11, inclusive, are equivalent circuit diagrams and directivity characteristic graphs in response to the position at which the feeding terminal of an antenna is connected and positions at which an impedance element is connected, respectively.
Figure 4B:
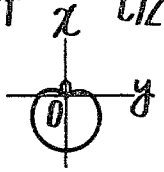
Figure 5A:
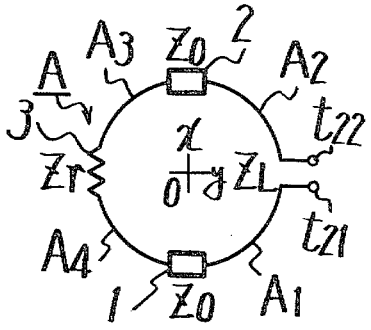
Figure 5B:
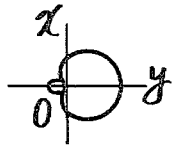

Turning to FIGS. 2 and 3, a practical example of the antenna system of this invention will be described. In FIGS. 2 and 3, the parts corresponding to those of FIG. 1 are marked with the same reference indicia. The opposing ends of four divided conductive members A1 to A4 of the antenna A at the respective divided points are marked at t11, t12, t21, t22; t31, t32; and t41, t42, respectively. In the following description, it is assumed that the plane of the antenna A is horizontal and is not rotated but is fixed in position. A parallel feeder PF1 of 300Ω is connected to the opposing ends t11 and t12 of the conductive members A4 and A1 as an electric power feeder line. Similarly, to the opposing ends t21, t22, t31, t32; and t41, t42 of the conductive members A1, A2; A2, A3; and A3, A4 connected are similar feeders PF2, PF3 and PF4, respectively. In the example of FIGS. 2 and 3, the antenna A is so designed that when the parallel feeders of 300Ω are connected to the divided points of the antenna A, respectively, matching is established, but the finally received output is derived through the coaxial cable of 75Ω. Therefore, in this example, baluns BL1, BL2, BL3 and BL4 are connected to the free ends of the feeders PF1 to PF4 for conversion of 300Ω to 75Ω, and the unbalanced output ends of the respective baluns BL1 to BL4 are marked at t10, t20, t30 and t40, respectively.

As will become clear from the following description either one of the output terminals t10, t20, t30 and t40 is connected to a power feeding terminal t0 connected to the cable XF, and the remaining output terminals are connected with impedance elements such as resistors of predetermined values, grounded or opened.

Turning to FIG. 3, a control circuit 36, which controls a control means 37, i.e., switch circuits SW1, SW2, SW3 and SW4 connected to the terminals t10 to t40, will be described. In FIGS. 2 and 3, it is noted that the terminals with the same references are connected together. The switch circuit SW1 consists of switching diodes D10, D11 and D12 whose cathodes are connected together to the terminal t10, the switch circuit SW2 consists of switching diodes D20, D21 and D22 whose cathodes are connected together to the terminal t20, the switch circuit SW3 consists of switching diodes D30, D31 and D32 whose cathodes are connected together to the terminal t30, and the switch circuit SW4 consists of switching diodes D40, D41 and D42 whose cathodes are connected together to the terminal t40, respectively. The anodes of the respective switching diodes D12, D22, D32 and D42 are connected through DC blocking capacitors C12, C22, C32 and C42 to the power feeding terminal t0.

The anodes of the diodes D11 and D21 are respectively connected together through DC blocking capacitors C11 and C21 and then to the ground through a common resistor 3' which will be a part of an impedance element connected to the divided point at the opposite side to the divided point to which the power feeding point of the antenna A is connected. Similarly, the anodes of the diodes D31 and D41 are connected together through DC blocking capacitors C31 and C41 and then grounded through a common resistor 3' which becomes a part of the similar impedance element. The anodes of the respective diodes D10, D20, D30 and D40 are grounded through capacitors C10, C20, C30 and C40, respectively.

Now, the control circuit 36 will be described. A receiver 38 is provided for receiving the wave emitted from the transmitter 15 which is already described in connection with FIG. 1. The receiver 38 includes the receiving element 13 such as a microphone when the untrasonic wave is emitted from the transmitter 15 (which may be an antenna when an electric wave is emitted from the transmitter 15) and a receiving circuit 30. Every time when the operating element 16 of the transmitter 15 is pushed down, the receiving circuit 30 produces one pulse which is in turn supplied to a ring counter 32. This ring counter 32 consists of stage circuits 32-1, 32-2, 32-3, 32-4 and 32-5 which will produce output pulses Q1, Q2, Q3, Q4 and Q5, respectively. The output pulse Q5 from the final stage circuit 32-5 is supplied to the respective stage circuits 32-1 to 32-5 as a reset signal. The output pulse Q1 is supplied through a resistor R12 to a terminal t102 and through a resistor R31 to a terminal t301. The output pulse Q2 is supplied through a resistor R22 to a terminal t202 and through a resistor R41 to a terminal t401. The output pulse Q3 is supplied through a resistor R11 to a terminal t101 and through a resistor R32 to a terminal t302, and the output pulse Q4 is supplied through a resistor R21 to a terminal t201 and through a resistor R42 to a terminal t402, respectively. The ends of the resistors R11, R12, R21, R22, R31, R32, R41 and R42 opposite to the terminals t101, t102, t201, t202, t301, t302, t401, and t402 are respectively grounded through capacitors C11, C12, C21, C22, C31, C32, C41 and C42. The output pulses Q1 to Q4 are supplied to a logic circuit 34 having the logic which will be described later, and the output pulse Q5 is supplied to a JK flip-flop circuit 33 whose output pulse Q6 is supplied to the logic circuit 34. An output pulse Q7 from the logic circuit 34 is delivered through a resistor Ra to terminals t103 and t303, and an output pulse Q8 from the logic circuit 34 is delivered through a resistor Rb to terminals t203 and t403.

The direction and directivity characteristic of the above antenna system can be varied in eight different manners, and by supplying the pulse to the ring counter 32 the outputs Q1 to Q8 become varied as shown in the following truth table. When pulses are supplied up to eight, the first state and the following states are continued from the next one pulse.

Truth Table

| No. | Q1 | Q2 | Q3 | Q4 | Q5 | Q6 | Q7 | Q8 |
|---|---|---|---|---|---|---|---|---|
| 1 | 1 | 0 | 0 | 0 | 0 | 1 | 0 | 0 |
| 2 | 0 | 1 | 0 | 0 | 0 | 1 | 0 | 0 |
| 3 | 0 | 0 | 1 | 0 | 0 | 1 | 0 | 0 |
| 4 | 0 | 0 | 0 | 1 | 0 | 1 | 0 | 0 |
| 5 | 1 | 0 | 0 | 0 | 1→0 | 0 | 0 | 1 |
| 6 | 0 | 1 | 0 | 0 | 0 | 0 | 1 | 0 |
| 7 | 0 | 0 | 1 | 0 | 0 | 0 | 0 | 1 |
| 8 | 0 | 0 | 0 | 1 | 0 | 0 | 1 | 0 |

In the above truth table, one of the output pulses Q1 to Q4 from the ring counter 32 becomes "1" successively and the other ones are "0", which is repeated. The output pulse Q5 from the ring counter 32 becomes "1" temporarily at the fifth pulse and becomes "0" immediately thereafter and is always "0" at other times. The output pulse Q6 from the flip-flop circuit 33 is selected to be "1" at the first state when the electric power is turned ON, so that the output pulse Q6 is "1" when the output pulse Q5 is "0" and becomes "1" temporarily at the fifth pulse, when the output pulse Q5, the flip-flop circuit 33 is driven by the output pulse Q5 and its output pulse Q6 becomes "0". The logic circuit 34 has such a logic that its output pulses Q7 and Q8 become as shown in the above truth table. From the first to fourth pulses, the output pulses Q7 and Q8 are both "0", and from the fifth to eighth pulses the output pulses Q7 and Q8 become "0" and "1" alternately but do not become "0" or "1" at the same time.

The operation of the above antenna system will be described with reference to FIGS. 4 to 21. In the case of FIG. 3, when the output pulse "1" is supplied to either of the terminals t101, t201, t301 and t401, either of the corresponding diodes D11, D21, D31 and D41 is turned ON. Thus, either of the terminals t10, t20, t30 and t40 is grounded through the resistor 3'. The terminal grounded through the resistor 3' is the terminal opposite to the terminal of terminals t10 to t40 which is connected to the power feeding terminal t0. While, when the output pulse "1" is supplied to either of terminals T102, t202, t302 and t402, the corresponding terminal of terminals t10 to t40 is connected to the power feeding terminal t0. When the output pulse "1" is supplied to either of terminals t103, t203, t303 and t403, the opposing two terminals in the terminals t10 to t40 are grounded, while when the output pulse "0" is supplied, either two opposing terminals in the terminals t10 to t40 are opened.

When one of terminals t10 to t40 is connected to the power feeding terminal t0 in FIG. 2, a load having an impedance ZL is equivalently connected between the opposing ends of the antenna A corresponding to the above one terminal. When one of the terminals t10 to t40 is grounded through the resistor 3', an impedance element 3 having the impedance ZL is connected between the opposing divided ends of the antenna A. Further, when the opposing two terminals in the terminals t10 to t40 are grounded or not grounded, impedance elements 1 and 2 with the impedances ZS and ZO are equivalently connected between opposing ends of the divided points corresponding to the above terminals.

FIGS. 4 to 11 are respectively diagrams showing the positions of the opposing ends at the divided points of the antenna A connected to the power feeding terminal t0, the connection positions of the corresponding impedance element 3 having the impedance Zr and the impedance elements 1 and 2 having the impedance ZO and ZS, equivalent circuits of the antenna system in accordance with whether the impedances of the impedance elements 1 and 2 are ZO or ZS, and the corresponding directivity characteristics (in the case of receiving the broadcast VHF television signal wave of 2 channels), respectively. FIGS. 4 to 7 are such cases in which as the impedance elements 1 and 2 impedance elements both having the impedance ZO are used, and FIGS. 8 to 11 are such cases in which impedance elements both having the impedance ZS are used as the impedance elements 1 and 2. The impedance element 3 is selected always as Zr.

In the cases of FIGS. 4B to 7B, the main lobes of the directivity characteristic curves are cardioid and small back lobes are present at the rear sides thereof, while in the cases of FIGS. 8B to 11B, the directivity characteristic curves have relatively small main lobes and relatively large back lobes, respectively. If it is assumed that the four divided opposing ends of the antenna A in FIG. 2 approximately coincide with x and y axes, the directivity is in the $-x$ direction in FIGS. 4 and 8, in the y direction in FIGS. 5 and 9, in the x direction in FIGS. 6 and 10, and in the $-y$ direction in FIGS. 7 and 11, respectively.

Figure 6A:
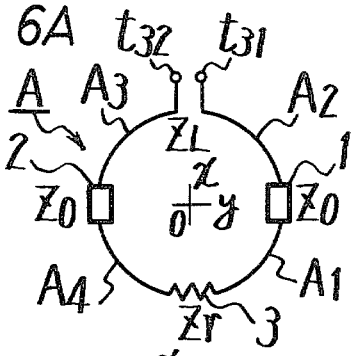
Figure 6B:
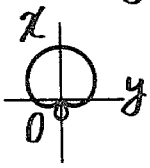
Figure 7A:
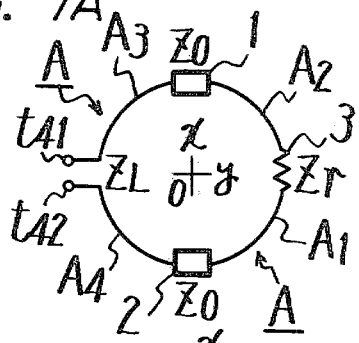
Figure 7B:
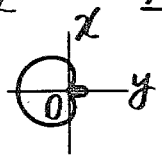
Figure 8A:
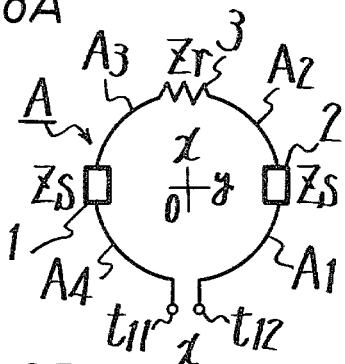
Figure 8B:
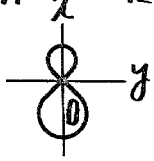
Figure 9A:
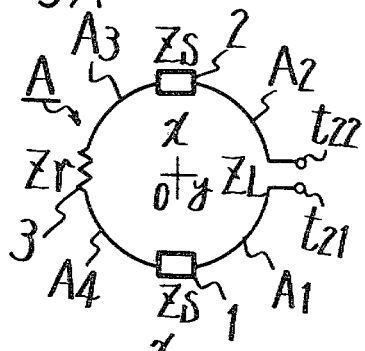
Figure 9B:
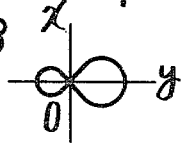
Figure 10A:
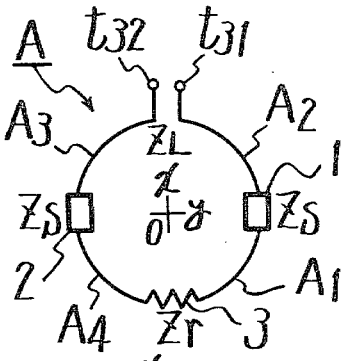
Figure 10B:
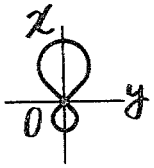
Figure 11A:
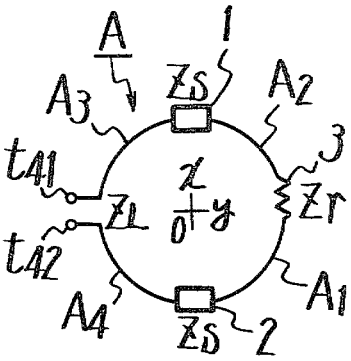
Figure 11B:
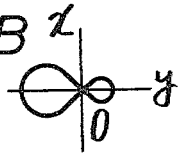
Figure 12:
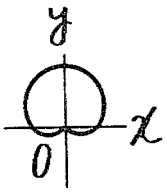
FIGS. 12 to 17, inclusive, are graphs showing directivity characteristics in the case where the receiving frequencies are different.
Figure 13:
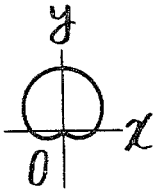
Figure 14:
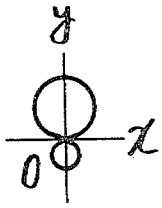
Figure 15:
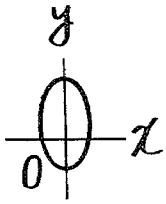
Figure 16:
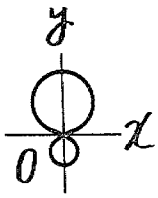
Figure 17:
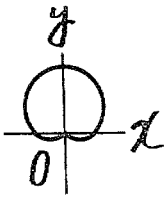

In general, the directivity characteristic varies dependent upon the frequency of arriving electric waves. By way of example, the directivity characteristics of the antenna system, which is formed as shown in, for example, FIG. 6, is shown in the graphs of FIGS. 12 to 14 at the frequencies of 50 $MH_z$, 100 $MH_z$ and 200 $MH_z$, respectively. FIGS. 15 to 17 show the directivity characteristics of the antenna system formed as shown in FIG. 10 at the received frequencies of 50 $MH_z$, 100 $MH_z$ and 200 $MH_z$, respectively.

Figure 18A:
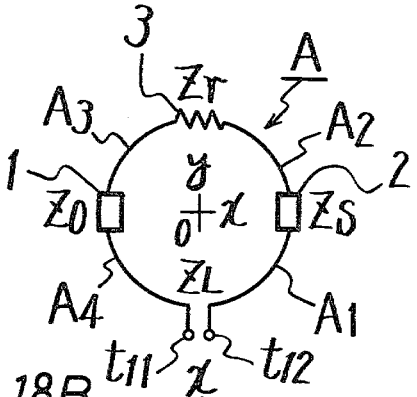
FIGS. 18 to 21, inclusive, are equivalent diagrams and graphs of another example of the invention similar to those of FIGS. 4 to 11.
Figure 18B:
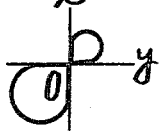
Figure 19A:
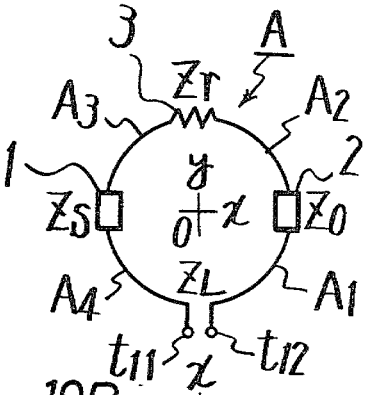
Figure 19B:
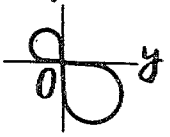
Figure 20A:
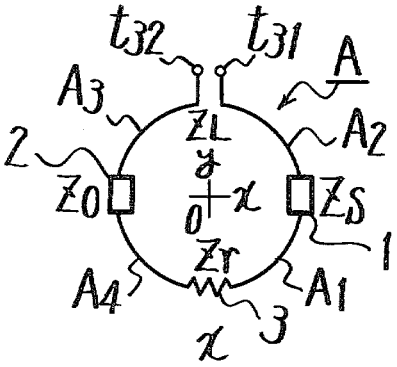
Figure 20B:
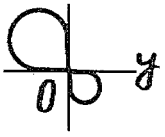
Figure 21A:
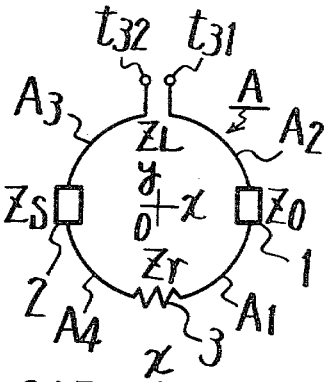
Figure 21B:
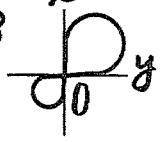

As described above, according to the present invention, the direction and directivity characteristic of the antenna system can be varied by eight different manners. In the above example of the invention, the dividing member of the antenna A is selected as four, but if this dividing number is increased, the number of directions and the directivity characteristic of the antenna system can be increased. However, while the dividing number is held at four further four different kinds are achieved in addition to the above eight kinds a total of twelve different patterns will be described with reference to FIGS. 18 to 21. This is achieved by the following manner. That is, if the impedances of the impedance elements 1 and 2, which are selected to be the same as ZO or ZS in the cases of FIGS. 4 to 11, are not selected to be the same, but are selected to be different, for example, one of the impedances is selected as ZO and the other is selected as ZS, it will be understood that while the direction shown in FIGS. 8 to 11 is changed at every 90°, it can be changed at every 45° as in the cases of FIGS. 8 to 11 and FIGS. 18 to 21. FIGS. 18 and 19 correspond to such a case that the output terminal t10 of the antenna A is connected to the power feeding terminal t0. In the case of FIG. 18, the impedances of the impedance elements 1 and 2 are selected as ZO and ZS, while in the case of FIG. 19, the impedances of the impedance elements 1 and 2 are selected opposite to the former case. FIGS. 20 and 21 correspond to such a case where the output terminal t30 of the antenna A is connected to the power feeding terminal t0, and in the case the impedances of the impedance elements 1 and 2 are selected as ZO, ZS or ZS, ZO the directivity characteristics shown in the figures result. In the above cases, the impedances ZS, ZO and Zr are selected as approximately 0Ω, 300Ω and 300Ω, respectively. Further, the resistance of the resistor 3' is 75Ω which is converted as Zr=300Ω. There is of course no need that the above impedances be limited to the above mentioned values, but the impedances can be selected as desired. Also, the dividing number of the antenna A, the position of the divided points and the values of the impedance elements connected thereto can be selected as desired.

According to the present invention described above, such an antenna system can be provided in which its direction and directivity characteristic can be varied by a simple construction without being influenced by electrical and mechanical noises.

Further, according to the above invention, a portable antenna system can be provided in which its direction and directivity characteristic can be remotely varied without being influenced by the approach of a human and his body.

The above description is given for a case wherein the present invention is applied to a receiving antenna system, but the invention can be applied to a transmitting antenna system with substantially the same effects.

In the above example, when the antenna system is for receiving a television broadcast wave, the transmitter 15 may be formed integrally with the transmitter which is used to changeably control the channel, sound volume and so on of a television receiver.

It will be apparent that many modifications and variations could be affected by one skilled in the art without departing from the spirits or scope of the novel concepts of the present invention, so that the spirits or scope of the invention should be determined by the appended claims only.

We claim as our invention:

1. An antenna system comprising, a loop antenna divided into four or more conductive members with their ends mounted adjacent to each other to form at least four divisional points between adjacent conductive members, a plurality of feeders with one connected to each of said divisional points respectively, a signal feeding point, and at least one impedance element, an electrical diode switching means connected to said plurality of feeders, to said signal feeding point, and to said one impedance element and electrical control means connected to said electrical diode switching means for selectively connecting said feeding point to one of said plurality of feeders and at the same time for selectively connecting said one impedance element to another of said plurality of feeders which is located on the opposite side of said loop antenna to which said feeding point is connected and a variable impedance connectable by said diode switching means to a third one of said plurality of feeders.

2. A broadcast antenna system according to claim 1, wherein said electrical control means includes a remote control apparatus for remotely controlling said electrical diode switching means.

3. A broadcast antenna system according to claim 2, wherein said remote control apparatus is of a wireless type including a transmitter and a receiver, and said receiver is provided in the body of said antenna system.

4. An antenna system according to claim 3, wherein said electrical control means includes a ring counter for controlling said diode switching circuit.

5. An antenna system according to claim 1 wherein said control circuit comprising a transmitter with actuator for transmitting a pulse each time said actuator is energized, a receiver for receiving said transmitted pulses, a multistage ring counter receiving the output of said receiver, a keying circuit receiving outputs from various stages of said ring counter and said electrical diode switching means receiving outputs of said various stages of said ring counter and said keying circuit.

6. Apparatus according to claim 5 including a flip-flop circuit connected between the last stage of said ring counter and said keying circuit.

7. Apparatus as claimed in claim 6 wherein said electrical diode switching circuits has four input terminals with a first one of said inputs connected to said feed point, second and third ones of said inputs connected to outputs of different stages of said ring counter and the fourth one of said inputs connected to an output of said keying circuit.

* * * * *